US008939298B2

(12) United States Patent
Willim

(10) Patent No.: US 8,939,298 B2
(45) Date of Patent: Jan. 27, 2015

(54) BALLAST CARRIAGE FOR A CRAWLER CRANE

(75) Inventor: Hans-Dieter Willim, Ulm-Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 779 days.

(21) Appl. No.: 12/868,509

(22) Filed: Aug. 25, 2010

(65) Prior Publication Data

US 2011/0049075 A1 Mar. 3, 2011

(30) Foreign Application Priority Data

Aug. 26, 2009 (DE) ..... 20 2009 011 577 U

(51) Int. Cl.
*B66C 23/74* (2006.01)

(52) U.S. Cl.
CPC ..... *B66C 23/74* (2013.01)
USPC ..... 212/198; 212/178; 212/279

(58) Field of Classification Search
USPC ..... 212/279, 195–198, 178, 276, 280–281, 212/291; 180/14.2, 14.6
See application file for complete search history.

(56) References Cited

U.S. PATENT DOCUMENTS

| | | | | | |
|---|---|---|---|---|---|
| 3,842,984 | A * | 10/1974 | Brown et al. | ..... | 212/195 |
| 4,243,148 | A * | 1/1981 | Lampson | ..... | 212/196 |
| 4,316,548 | A * | 2/1982 | Helm et al. | ..... | 212/196 |
| 4,540,097 | A * | 9/1985 | Wadsworth et al. | ..... | 212/196 |
| 4,711,358 | A * | 12/1987 | Konishi | ..... | 212/178 |
| 4,771,838 | A * | 9/1988 | Ketcham | ..... | 180/6.62 |
| 6,283,315 | B1 * | 9/2001 | Willim et al. | ..... | 212/279 |
| 7,637,512 | B1 * | 12/2009 | McGhie et al. | ..... | 280/93.504 |
| 2005/0098520 | A1 * | 5/2005 | Frankenberger et al. | ..... | 212/276 |
| 2007/0193795 | A1 * | 8/2007 | Forsyth | ..... | 180/65.4 |

* cited by examiner

*Primary Examiner* — Sang Kim
*Assistant Examiner* — Nathaniel Adams
(74) *Attorney, Agent, or Firm* — Alleman Hall McCoy Russell & Tuttle LLP

(57) ABSTRACT

The present disclosure relates to a crane with a travelling undercarriage, an uppercarriage rotatably mounted on the same with a luffing boom and derrick boom arranged on the same, and a ballast carriage connectable with the uppercarriage via a coupling element, wherein the ballast carriage is a standardized heavy-duty transport device with separate drive and separate drive controller, and wherein this drive controller can be influenced as a result of the movement of the crane.

15 Claims, 10 Drawing Sheets

BALLAST CARRIAGE FOR A CRAWLER CRANE

CROSS REFERENCE TO RELATED APPLICATION

This application claims priority to German Utility Model Application No. 20 2009 011 577.1, entitled "Crane", filed Aug. 26, 2009, which is hereby incorporated by reference in its entirety for all purposes.

FIELD

The present disclosure relates to a crane with a travelling undercarriage, an uppercarriage rotatably mounted on the same with a luffing boom and derrick boom arranged on the same, and a ballast carriage connectable with the uppercarriage via a coupling element.

BACKGROUND AND SUMMARY

Cranes of this type generally are configured as crawler cranes and known per se. The ballast carriage here is used to be able to also move the crane with the derrick ballast while the crane is unloaded, or to rotate the crane under partial load. The derrick ballast each is suspended at the head piece of the derrick boom.

The ballast carriages of the so-called crawler cranes previously have been configured as a special component of the entire crane with few large wheels. However, these ballast carriages involve the disadvantage that they are only suitable for use on the crane and thereby substantially increase the investment sum for the entire crane.

Simply omitting the ballast carriage in particular in constructions of large cranes, as they are increasingly required for example for building nuclear power plants, is not possible.

Therefore, it is the object of the present disclosure to develop a generic crane such that even when constructed as large crane it can do without an additional individually constructed ballast carriage adapted to the respective large crane.

In accordance with the present disclosure, this object is solved by a crane with a travelling undercarriage, an uppercarriage rotatably mounted on the same with a luffing boom and derrick boom arranged on the same, and a ballast carriage connectable with the uppercarriage via a coupling element, in which the ballast carriage is a heavy-duty transport device with separate drive and separate drive controller, wherein this drive controller can be influenced as a result of the movement of the crane. The heavy-duty transport device may be of a standard variety, including having standardized sizes, weights, and/or other such features.

In accordance with the present disclosure, a standard heavy-duty transport vehicle therefore is used, as it is employed already in a large number by the users of cranes for moving heavy loads, such as bridge elements or parts of oil rigs. Such heavy-duty transport vehicles have a separate drive and a separate drive controller. Since the driving forces of a heavy-duty transport device or a heavy-duty transport vehicle are relatively high, a high lateral force can be introduced to the crane when rotating the crane. This high lateral force is transmitted to the derrick boom, at whose head piece the derrick ballast is suspended. However, since a derrick boom basically represents a pressure rod, it is extremely sensitive to lateral forces. In accordance with the present disclosure, the drive controller of the heavy-duty transport device therefore is formed such that it can be influenced as a result of the movement of the crane.

Due to this influence, the drive controller of the heavy-duty transport device in accordance with one embodiment can be configured such that when rotating the crane it automatically determines the corresponding steering center and in towing operation behind the crane steers, accelerates or decelerates automatically. As another example, the drive controller of the heavy-duty transport device may adjust operation of the heavy-duty transport drive in response to movement of the crane, such as in response to a length of the variable length coupling element.

Even if in another variant the drive controller of the ballast carriage has not been upgraded such that it can automatically perform the aforementioned controls, the fact that the drive controller can be influenced by the crane movement in accordance with the present teaching ensures that for the case that a steering error of the heavy-duty transport device leads to an undesired introduction of force into the coupling element between the uppercarriage and the ballast carriage the separate drive of the heavy-duty transport device stops the entire system, i.e. both the crane and the heavy-duty transport device, so that for example by manual control the ballast carriage can again by moved into the desired position by means of its own drive. Subsequently, operation of the crane can again be continued.

Further preferred aspects of the present disclosure can be taken from the sub-claims following the main claim.

The coupling element between the uppercarriage and the ballast carriage can be designed to be variable in its length and can include a length sensor. The coupling element advantageously can consist of two articulated rods which are coupled via a hydraulic cylinder acting as length sensor. The length of the hydraulic cylinder now is monitored via a corresponding sensor communicating with one or more of the drive controllers. Each change in stroke of the hydraulic cylinder is detected and converted into an actuation signal, which can be used for correction of the steering error or for switching off. In towing operation behind the crane, the ballast carriage can be accelerated, decelerated or also stopped, depending on the deflection of the piston in the hydraulic cylinder.

In accordance with another preferred aspect of the present disclosure, the ballast is placed on a pallet which can be mounted on the heavy-duty transport device and be connected with the same. In this way, a heavy-duty transport device already present with the user can be employed as ballast carriage in a particularly easy way. It must only be ensured that the corresponding pallet is connected with the heavy-duty transport vehicle after being mounted correspondingly.

In accordance with a further preferred embodiment, a rigid guide frame is created as coupling element between the uppercarriage and an articulation point on the pallet picking up the ballast and putting the same down on the ballast carriage, wherein the guide frame is movably mounted with respect to the articulation point in the articulation region such that a relative longitudinal movement with a deviation from a neutral position can be detected and can be converted into an actuation signal for the drive controller of the heavy-duty transport device.

This guide frame provided as coupling element has such a great stability that it introduces all the lateral forces, which as a result of travelling and rotating the entire system of crane and heavy-duty transport device act on the same, into the uppercarriage and here in particular into the turntable frame.

Advantageously, the slewing gear transmission of the crane is switched for concentricity when travelling or rotating, in order to prevent an overload of the guide frame. However, the guide frame can also be dimensioned such that when the brake used for braking the rotary movement of the uppercarriage around the undercarriage is engaged, the brakes will slip through before the guide frame as a whole is overloaded.

In accordance with an advantageous development of the above-described preferred variant, the relative longitudinal movement is realized by a longitudinal guide with a pivot pin such that both a longitudinal movement and a rotary movement is permitted, whereas no movement is permitted in transverse direction. By restricting the movement in transverse direction it is prevented that undesired lateral forces are transmitted to the derrick boom.

In accordance with a further development of this variant, it should be noted that the pallet hangs on pendulums consisting of rods, which at their upper end are articulated to the rigid guide frame and at their lower end to the pallet directly or indirectly via spherical plain bearings. To avoid a too much inclined position of the heavy-duty transport device and in particular of the ballast piled up on the same during a possible relative movement between crane and heavy-duty transport device, the pendular movement can be limited by emergency stops to be provided correspondingly.

Quite particularly advantageously, the pendular movement can be detectable via measuring means, preferably angle sensors, such that due to the measured variables detected actuation signals can be generated for the drive controller.

For the case that the crane must be moved without load over a greater distance, the coupling element can be separable from the uppercarriage and/or ballast carriage, so as to move crane and heavy-duty transport device independent of each other.

Further features, details and advantages of the present disclosure will be explained in detail below with reference to embodiments illustrated in the drawing, in which:

DETAILED DESCRIPTION

Figure 1:
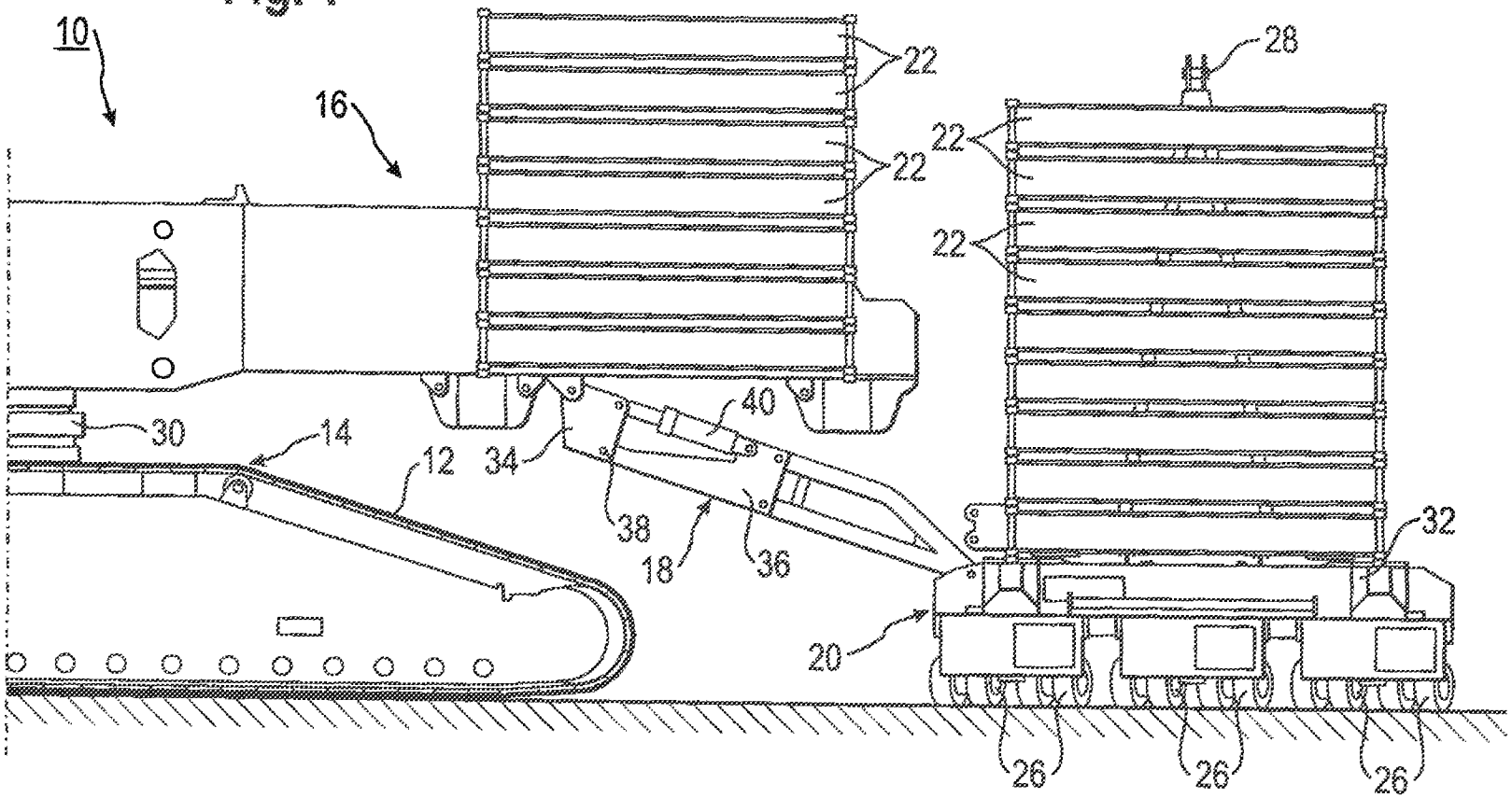
FIG. 1 shows a detailed representation of a crane with ballast carriage according to a first variant of the present disclosure.

FIG. 1 shows a crane 10 with an undercarriage 14 travelling by means of a tracklaying gear 12 and an uppercarriage 16 rotatably mounted on the same, which uppercarriage in a usual manner—not shown here—includes a boom and a derrick boom as well as a ballast carriage 20 connectable with the uppercarriage via a coupling element 18. Both on the uppercarriage 16 and on the ballast carriage 20 ballast plates 22 are deposited. This can also be taken in particular from the perspective representation of FIG. 2. The crane 10 may be moved, positioned, and adjusted by a controller receiving various signals, and the ballast carriage may be moved, steered, adjusted, and positioned by a separate controller receiving various signals.

Figure 3:
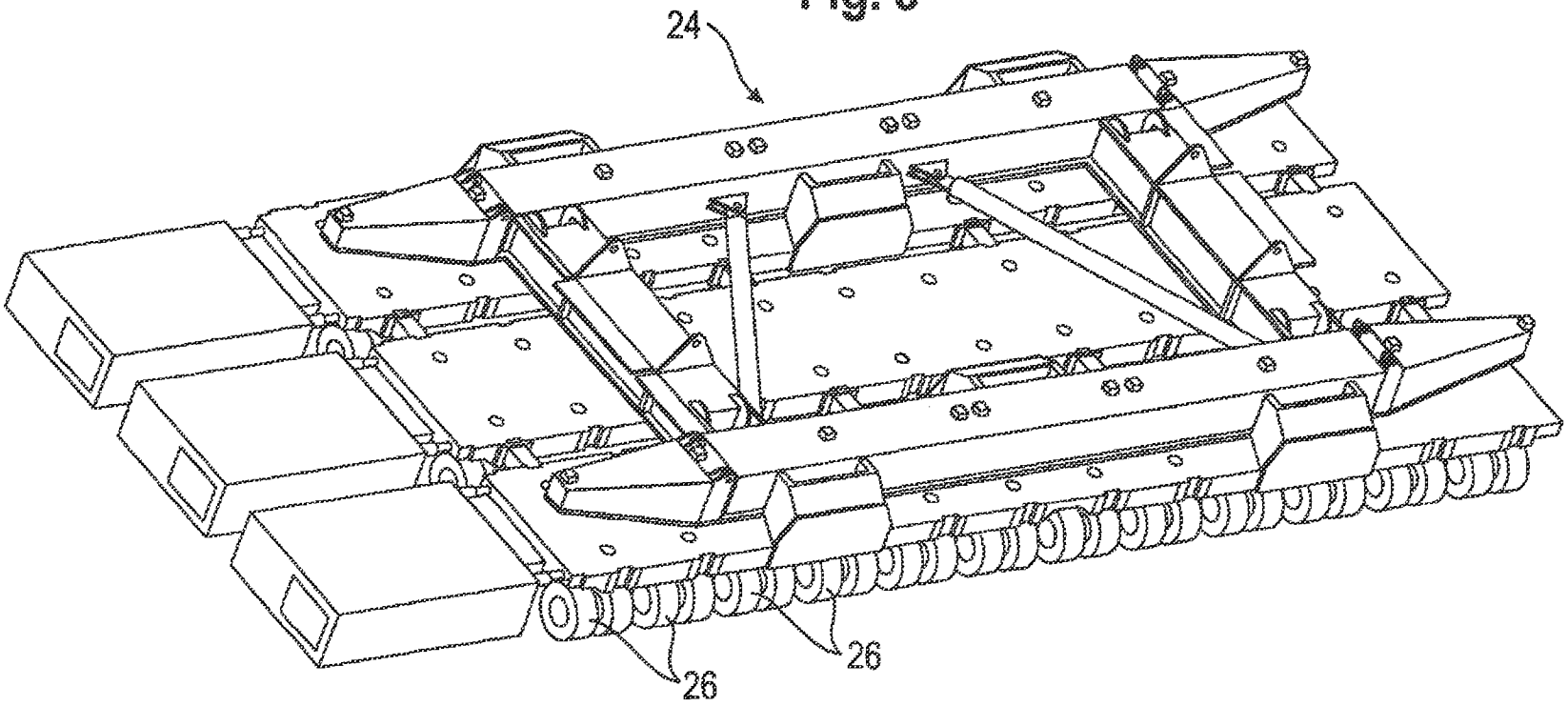
FIG. 3 shows a perspective view of a heavy-duty transport device as it can be used in accordance with the present disclosure.

The ballast carriage 20 consists of a heavy-duty transport device 24 known per se from the prior art and present with the users of the cranes, as it is shown for example in FIG. 3. In contrast to the ballast carriages known so far, which were constructed especially for large cranes and delivered together with the same, the heavy-duty transport devices have a plurality of small wheels 26. As can be taken from FIGS. 1 and 3, the same are arranged quite uniformly below the heavy-duty transport device. Such heavy-duty transport devices can pick up great loads and are employed by the users of cranes for example for moving bridge elements or parts of oil rigs or other massive parts. In accordance with the present disclosure, the uppercarriage 16 of the crane 10 now is connected with the heavy-duty transport vehicle 20 by means of a stable guide consisting of the coupling element 18. This guide consisting of the coupling element 18 must be dimensioned strong, so that all occurring transverse forces can be absorbed by this guide.

Figure 2:
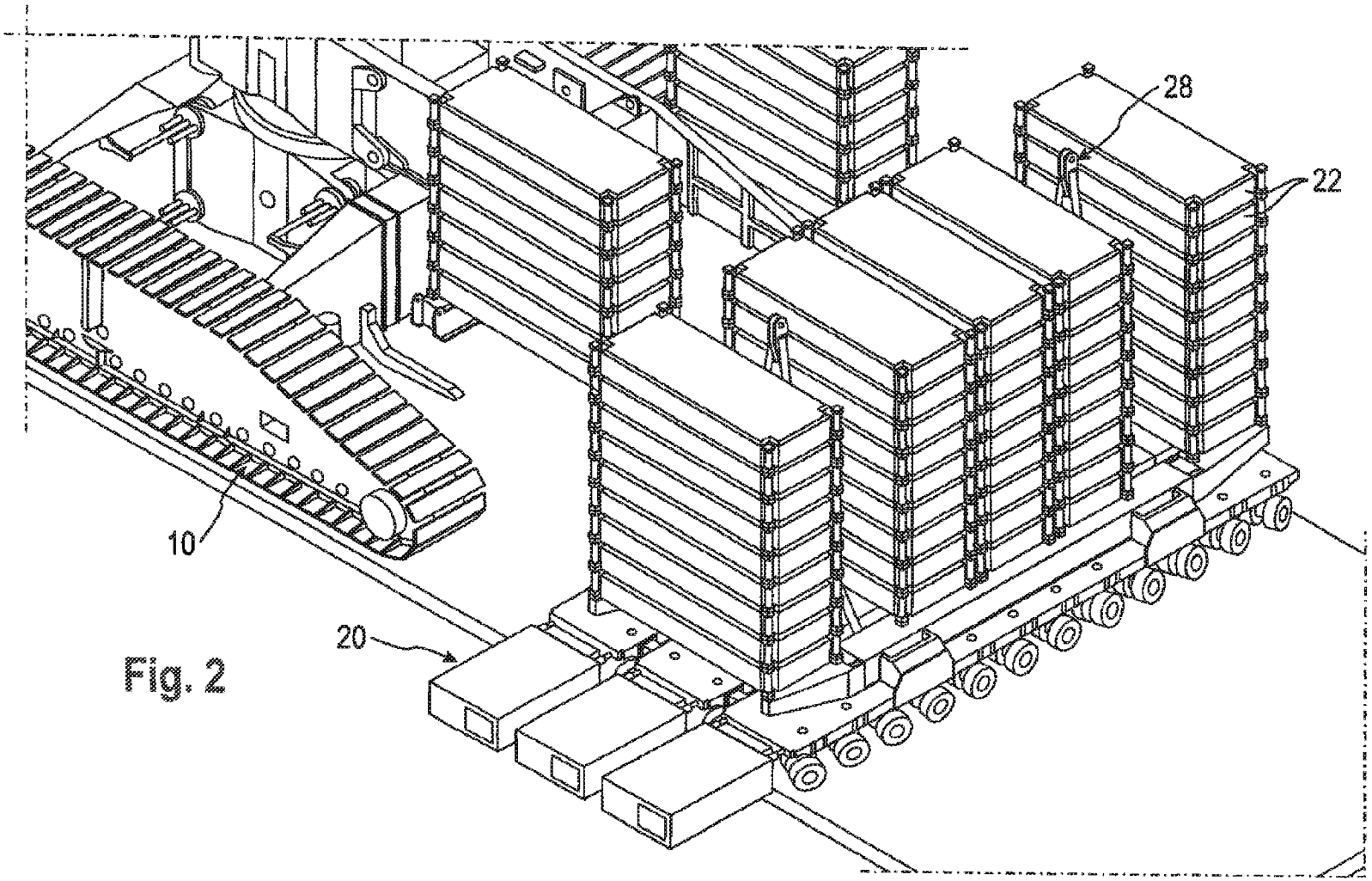
FIG. 2 shows another detailed view of the crane according to FIG. 1.

This is necessary because the ballast carriage hangs on the tip of the derrick boom in a manner not shown in detail in the drawings and cannot absorb any lateral forces. In FIGS. 1 and 2, the articulation points for the suspension on the derrick boom are designated with 28. Since the derrick boom of the crane, on whose tip the ballast carriage is suspended, cannot absorb any lateral forces, all forces resulting from steering errors or from different drives of the slewing gear 30 between crane undercarriage 14 and crane uppercarriage 16 on the one hand and from the heavy-duty transport device 24 on the other hand must be absorbed by this guide.

The slewing gear drive 30 of the crane 10 advantageously is configured such that wet brakes are present, so that in the case of an overload, which for example can be the result of excessive driving forces of the heavy-duty transport vehicle, the slewing gear transmission brakes can slip through.

The heavy-duty transport device 24 has a separate drive and a separate drive controller. This drive controller can be influenced as a result of the movement of the crane. In the variant shown in FIGS. 1 and 2, the coupling of the controller is effected in dependence on the movement of the crane, as set forth below. The basic movements of the crane on the one hand consist in rotating the uppercarriage and on the other hand in the towing operation, i.e. the drive in which the ballast carriage follows the crane.

When rotating the crane, the fixed distance between the rotation center of the crane 10 and the center of the derrick ballast pallet 32 mounted on the heavy-duty transport device 24 is entered into the drive controller.

The radius can be variable in fixed steps. In accordance with one variant, the radius can, however, also be variable by incorporation of an additional hydraulic cylinder in the coupling element 18.

The coupling element 18 substantially consists of two articulated rods 34 and 36, which are pivotable with respect to each other about a pivot point 38. The articulated rods 34 and 36, which in the embodiment according to FIGS. 1 and 2 are not realized as rods as such, but as constructively designed components, are connected with each other via a hydraulic cylinder 40.

During operation, the hydraulic cylinder 40 is switched for concentricity. This means there is a hydraulic compensation between the ring surface and the piston surface (not shown here).

The length of the hydraulic cylinder itself is monitored by a sensor which can pick up the changes in length (not shown here). The kink of the two articulated rods 34 and 36, i.e. their mutual swivelling about the swivel point 38, is designed such that the hydraulic cylinder is located at about 50% of its maximum stroke, if the derrick plate 32 is located at the correspondingly adjusted radius.

Since on rotating the crane uppercarriage 16 and the ballast carriage following the heavy-duty transport device 24 the distance between the rotation center of the crane and the center of the derrick pallet 32 mounted on the heavy-duty transport device can be varied due to steering errors of the heavy-duty transport device 24, the length sensor at the hydraulic cylinder 40 monitors whether these steering errors and the resulting deviation from the turning radius still are tolerable. When a certain limit value is exceeded, an advance warning is issued. When a further limit value is exceeded, a switch-off of the entire system is initiated. In the case of a reduction of the radius due to a steering error, the stroke of the hydraulic cylinder 40 is reduced, which is detected by the length sensor. When the steering radius now leads to an increase of the turning radius, the stroke of the hydraulic cylinder is increased correspondingly, which likewise is detected by the length sensor and processed further as drive control signal.

In one embodiment, the stroke of the hydraulic cylinder for example can be 50% with a radius of 20 m. When the radius now is exceeded by 0.8 m, an advance warning is issued in the crane operator cabin. A switch-off of the slewing gear is effected, when the radius has increased by 1 m, for example.

In towing operation of the driven heavy-duty transport device 24, the steering center is calculated continuously in dependence on the angle between the line of symmetry of the tracklaying gear 12 of the crane and the line of symmetry of the line of rotation or the guide of the heavy-duty transport device. The coordinates of the steering center are calculated based on the center of the heavy-duty transport device 24. In towing operation, the speed of the heavy-duty transport device is controlled automatically via the stroke of the cylinder 40 on the coupling element, as follows: When the tracklaying gear starts the forward drive, while the heavy-duty transport device initially stands still, the hydraulic cylinder is extended and a larger stroke of about 60% is obtained. From a stroke of 60%, the heavy-duty transport vehicle is accelerated forwards with increasing speed, with the stroke of the cylinder again being reduced of course. In this way, the speed of the heavy-duty transport device can be reduced again.

During a rearward drive of the tracklaying gear 12, the heavy-duty transport device 24 is accelerated backwards e.g. with a stroke of 40%, until the position of the hydraulic cylinder has again been adjusted in the center position. By means of this control, an automatic following of the heavy-duty transport vehicle is achieved. Should the stroke of the piston in the hydraulic cylinder 40 now come near to the end position, a warning and a short time later an emergency stop will be initiated by additional limit switches.

Particularly advantageously, the normal derrick ballast pallet in accordance with this variant, which usually is employed in suspended ballast operation, simply can be placed on the heavy-duty transport device 20 and be mechanically connected with the same.

Figure 5:
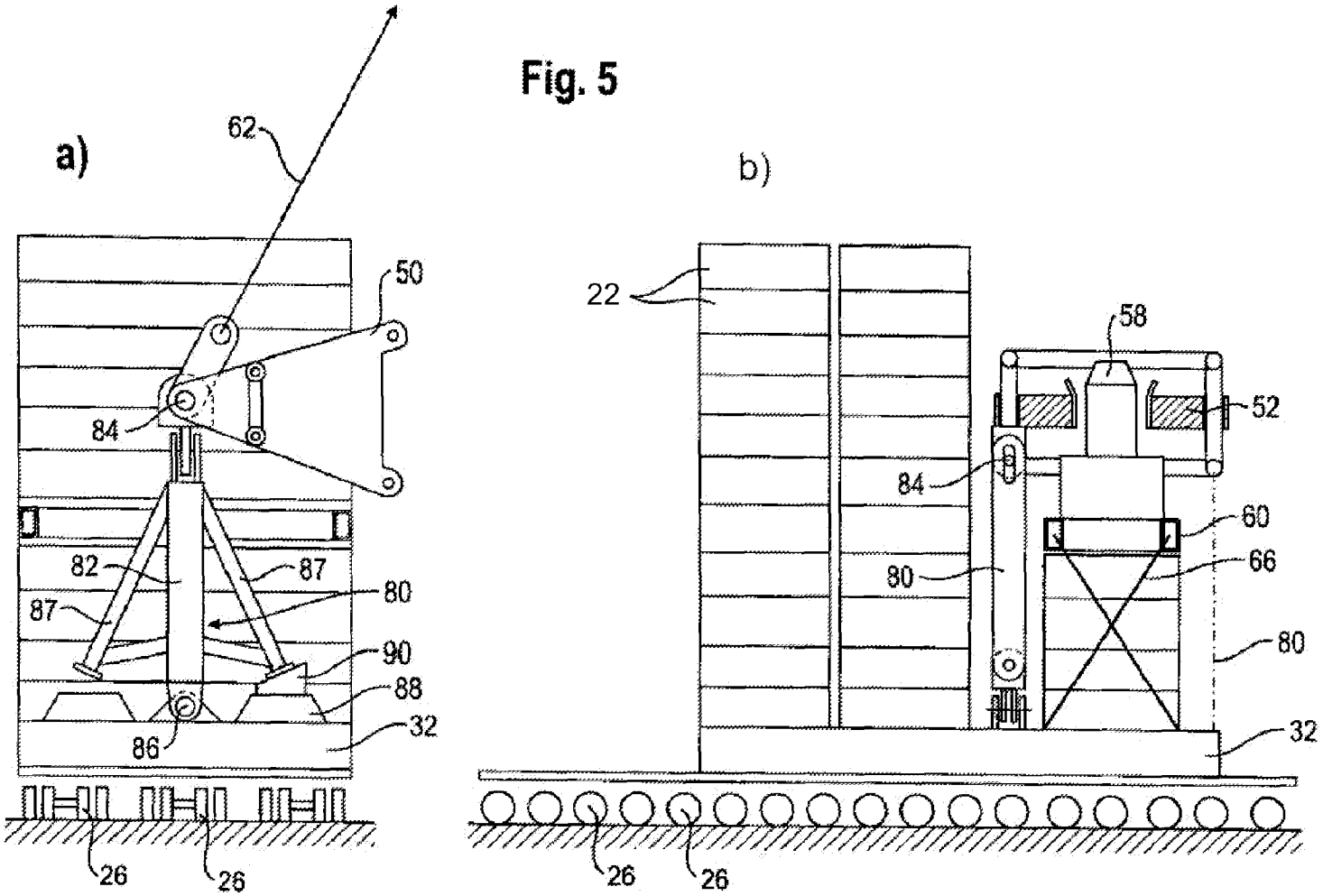
FIGS. 5*a* and 5*b* show a schematic side view and a schematic front view of a detail of a further variant of the crane in accordance with the present disclosure.
Figure 6:
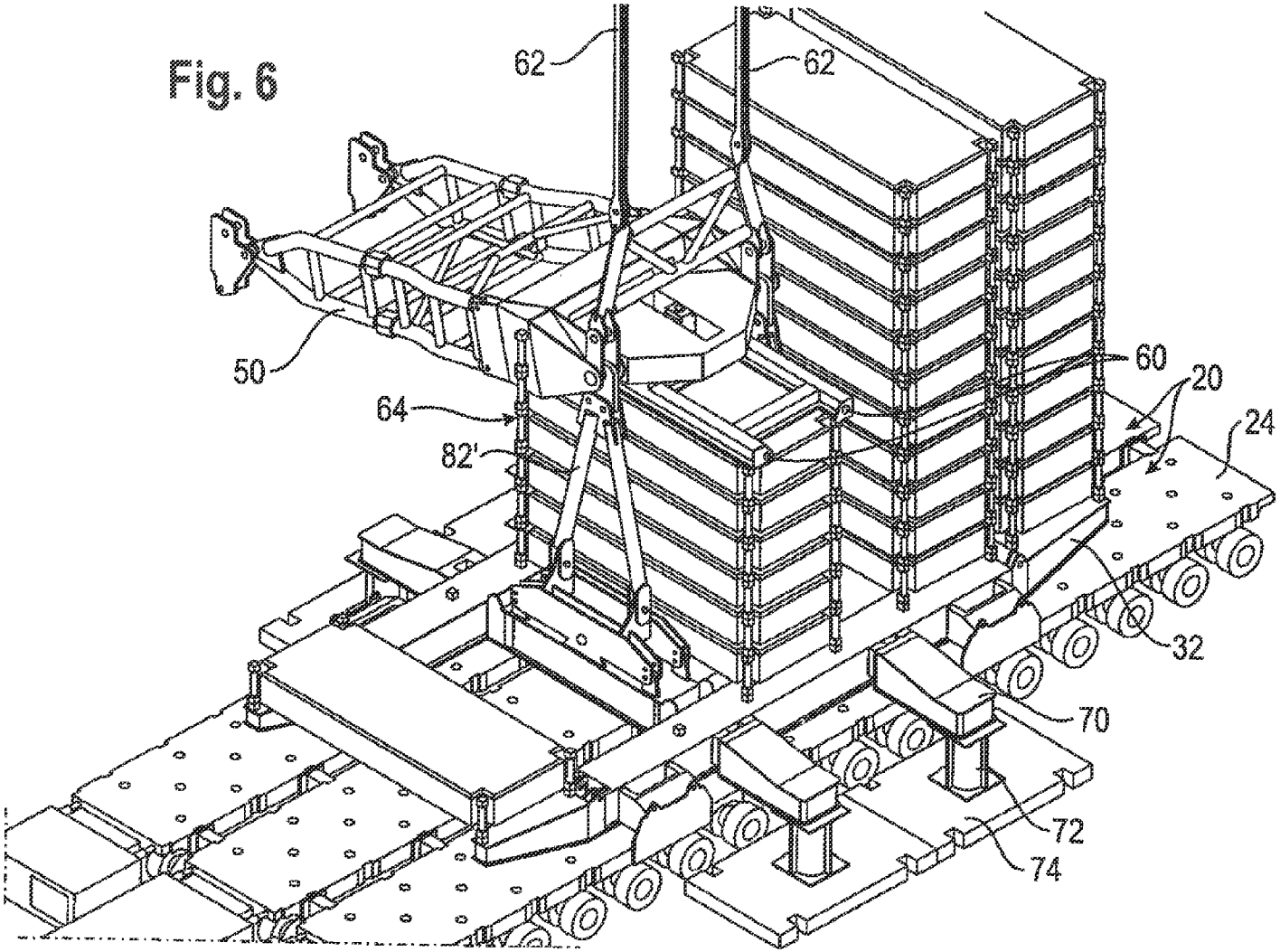
FIG. 6 shows a perspective representation of the variant as represented in FIG. 5.
Figure 7:
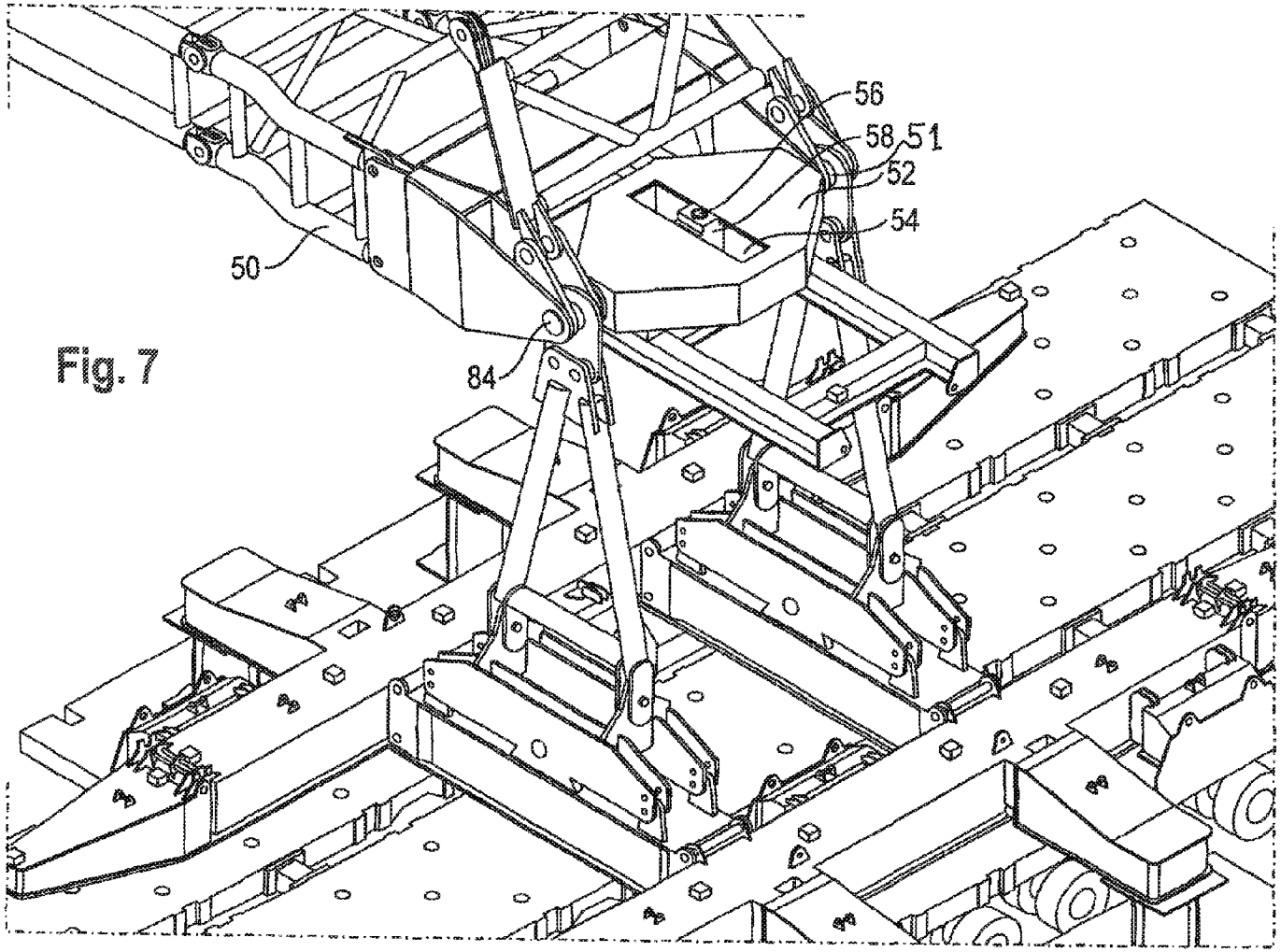
FIG. 7 shows a detail of the embodiment of FIG. 6 without piled-up ballast.
Figure 8:
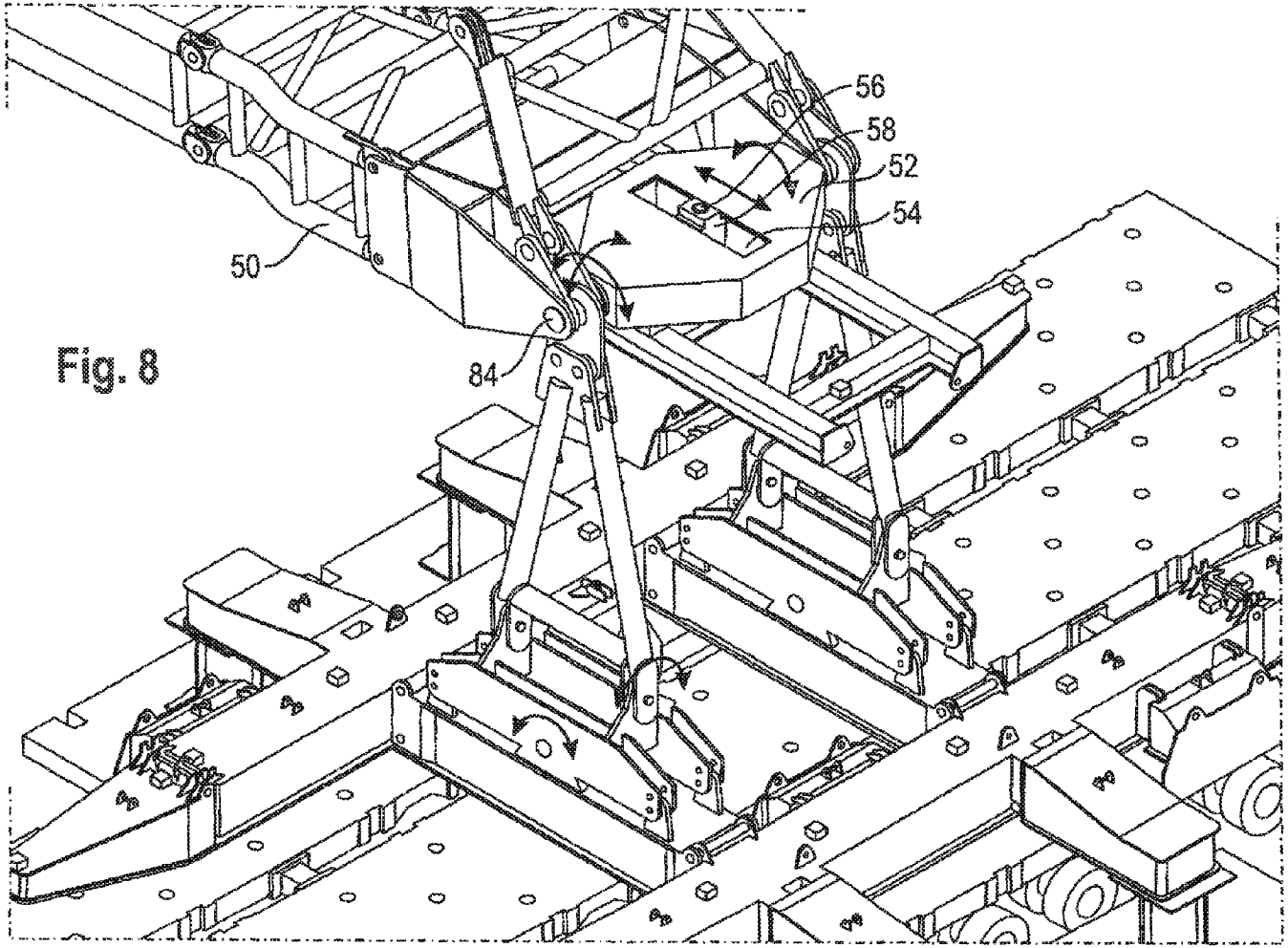
FIG. 8 shows a representation corresponding to FIG. 7, in which possible degrees of freedom are indicated.

Another variant of the present disclosure is shown in FIGS. 5 to 9. To avoid lateral forces on the derrick boom not shown here as coupling element, a stable guide frame 50 is provided, which consists of a lattice structure as shown in the representation of FIG. 6. For smaller ballast spacings, this guide frame can span a distance of about 20 m as coupling element. In large cranes, however, coupling elements and hence corresponding guide frames 50 can be used with a length of 50 m and more. These guide frames 50 can be constructed in modular fashion of a plurality of lattice elements, so that different lengths are obtained. Alternatively or in addition, partial regions or complete regions can, however, also be bridged by extension cylinders as stable guiding element. Via a corresponding push-out mechanism, a continuous length adjustment of the distance between the uppercarriage 16 of the crane 10 and the heavy-duty transport device 24 hence would be possible.

The guide frame 50 now introduces the entire lateral forces resulting from driving or rotating into the uppercarriage 16.

The slewing gear transmission of the crane 10 is switched for concentricity on driving or rotating. Alternatively, the guide frame here can also be dimensioned such that when the brake (for braking the rotary movement of the uppercarriage and the undercarriage) is engaged, the brakes will slip through before the guide frame is overloaded.

At the end of the guide frame 50, which serves for coupling the heavy-duty transport device 24, a coupling element or plate 52 is disposed (FIG. 7), in which a longitudinal guide 54 is provided. This longitudinal guide is running on a pivot pin 56, on which a sliding block 58 is seated. As a result, the sliding block 58 can perform both a rotary movement and a longitudinal movement inside the longitudinal guide 54. In transverse direction, however, the sliding block 58 rests against the longitudinal guide 54, so that the system is rigid in transverse direction. The sliding block itself is mounted on a stable frame 60 firmly connected with the ballast pallet 32.

From the end of the guide frame, two bracing rods 62 extend towards the tip of the non-illustrated derrick boom (FIG. 6). A frame 60 diagonally lashed against transversal forces with corresponding lashing means 66 (cf. FIG. 5*b*) is disposed on the middle ballast stack 64 shown in FIG. 6, which frame hence is firmly connected with the ballast pallet 32. For this purpose, corresponding connection tabs are provided.

Since the drive of the heavy-duty transport device 24 now is utilized for rotating the uppercarriage 16, power transmission is effected via the heavy-duty transport device 24, the ballast pallet 32 mounted thereon with mechanical means, the lashing means 66, the frame 60, the pivot pin 56 and the sliding block 58, the plate 52 comprising the same, the swivel bearing 51 connecting the plate 52 with the guide frame 50 and the uppercarriage 16.

To enable the heavy-duty transport device 24 to drive under the ballast pallet 32, a plurality of brackets 70 are provided on the ballast pallet 32 (cf. FIG. 6), which can rest on props 72 of variable height. For supporting the props 72 on the ground, load distribution mattresses 74 as shown in FIG. 6 generally are necessary in addition.

In accordance with the variant as shown in FIG. 5, the ballast pallet 32 hangs on two pendulums 80, which consist of simple rods 82 (cf. FIG. 5) or of triangular rod units 82' (cf. FIG. 6). At the upper and lower ends, these pendulums 80 each are connected with the ballast pallet 32 on the one hand and with the guide frame 50 on the other hand via a spherical plain bearing or universal joint 84, 86 (cf. FIG. 5*a*), so that the same are movable in all transverse directions.

In ballast carriage operation, the rods 87 extending at an angle or the rods 82' of the triangular construction of FIG. 6, which anyway are disposed at an angle, serve as emergency stop 88. The two pendulums 80 can freely rotate about the point 84. Should the heavy-duty transport device 24, i.e. the ballast carriage, lift off with a high overload of the crane, it is ensured by means of the emergency stops that the ballast pallet only can tilt forward or backward by a limited angle, since the center of gravity is positioned high. This in turn ensures that the ballast plates 22 cannot fall down from the ballast pallet 32, since this would of course immediately lead to the failure of the entire crane.

When the crane 10 rotates about the rotation center, the lateral deflection of the guide frame 50 for example can lead to the fact that the steering angle of the wheels 26 of the heavy-duty transport device 24 does not correspond with the theoretical steering angle, whereby the steering center moves out of the center of the crane 10.

The consequence is that the heavy-duty transport vehicle more and more deviates from its theoretical circular path and accordingly the center of the heavy-duty transport vehicle moves out of the circular path of the derrick head piece. Here, it should again be recalled that transversal forces must always be avoided, since they cannot be absorbed by the derrick boom.

Due to the above-described special suspension of the pendulum 80, the heavy-duty transport device now can deviate for example by +/−500 mm from its theoretical path, without essential additional forces being exerted on the derrick boom (not shown here in detail) or the crane 10.

If the heavy-duty transport device 24 now deviates from the theoretical path by more than the admissible amount indicated above, a switch-off of the rotary movement is effected by corresponding control signals for example via an angle sensor (not shown here in detail), which is arranged at the pendulums 80.

Another possibility now consists in that the respective deviations of the pendulums from the vertical are used to make corrections at the steering of the heavy-duty transport device 24, in order to thereby achieve a return into the theoretical track.

If due to a steering error of the heavy-duty transport device 24 the axis of symmetry of the heavy-duty transport device no longer is aligned at right angles to the axis of symmetry of the guide frame 50, this would lead to different positions of the two pendulums 80. By comparing these two angles, both a length correction and a final shut-off can be provided when the deviation is too great.

When driving straight ahead, the crane 10 will be moved together with the heavy-duty transport device 24, and via the inclined position of the pendulums 80 a speed control of the heavy-duty transport vehicle can also be effected here as follows:

First, the tracklaying gear 12 (FIG. 9) starts to move forward, wherein the pendulums 80 incline forward and actuate the travelling gear drives of the heavy-duty transport device in proportion to their deflection.

If the heavy-duty transport device is too fast, the pendulum 80 is deflected backwards, whereby the driving speed is reduced.

In towing operation, the crane 10 now is moved correspondingly with the heavy-duty transport device 24. Via the inclined position of the pendulums 80, a speed control of the heavy-duty transport device 24 can be effected.

First, the tracklaying gear 12 starts to move forward, wherein the pendulums 80 incline forward and actuate the travelling gear drives of the heavy-duty transport device in proportion to their deflection. When the heavy-duty transport device is too fast, the pendulum is again deflected backwards, whereby the driving speed is reduced. It should be considered that both the tracklaying gear 12 and the wheels 26 are driven. When driving straight ahead, the heavy-duty transport device can follow the crane in the manner described above. When the undercarriage 14 rotates on the spot, the uppercarriage 16 remains largely unmoved, with the undercarriage being moved about the axis of rotation of the uppercarriage. When the new direction of travel of the undercarriage is reached due to the differential speeds of the tracklaying gears, the heavy-duty transport device 24 is aligned about the axis of rotation into the new driving direction together with the guide frame and the uppercarriage. The individual wheel sets of the heavy-duty transport device are changed from the rotary movement in the direction of driving straight ahead.

Figure 9:
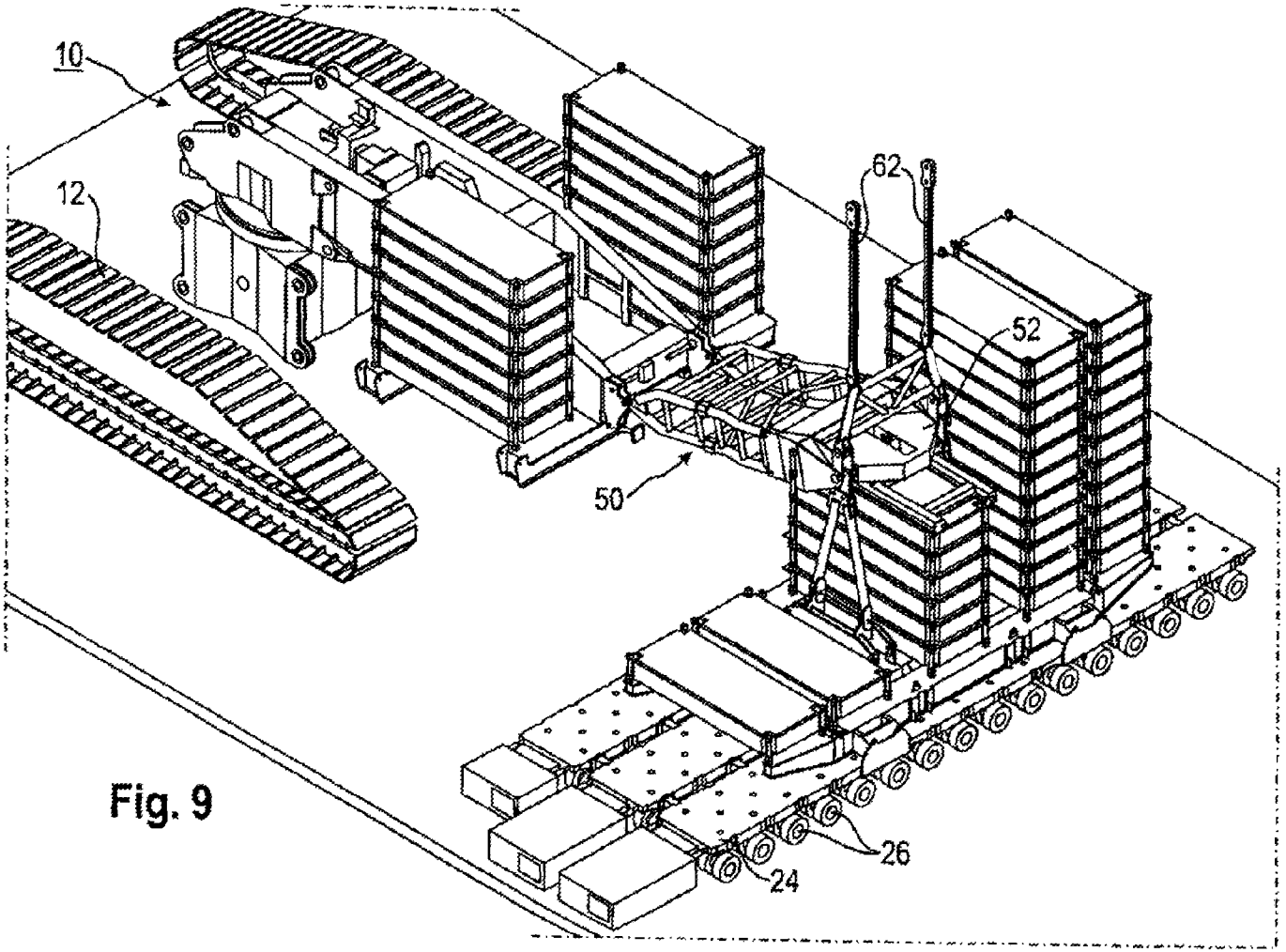
FIG. 9 shows a representation of parts of the crane in conjunction with the ballast carriage.

Corresponding to the construction shown for example in FIG. 9 it is ensured that the weight of the guide frame 50 and of the plate 52 does not hang on the derrick boom even if the crane is unloaded. The force must be absorbed by the ballast carriage 20, i.e. by the heavy-duty transport device 24. For this purpose, the plate 52 can either be mounted in an oblong hole to be vertically adjustable or the pendulums 80 are sufficiently strong and safe against buckling. If due to a steering error of the heavy-duty transport device 24 the axis of symmetry of the heavy-duty transport device 24 no longer is aligned at right angles to the axis of symmetry of the guide frame 50, this will lead to different angular positions of both pendulums 80. By comparing these angles, both a steering correction and a final shut-off can be effected when the deviations are too great.

In principle, the ballast pallet 32 can also be operated without heavy-duty transport device 24. In this case, wedges 90 (cf. FIG. 5*a*) are inserted on both sides on the right and left. In another embodiment not shown here, the function of these wedges theoretically can also be performed by bolt connections or the like.

In this way, the pendulums 80 are fixed in their vertical position on both sides, whereby it is ensured that the suspension point 84 of the guide is located above the swivel point of the entire ballast and hence tilting of the ballast is excluded.

In unloaded cranes on a difficult route, which requires a multitude of steering movements, the ballast carriage 20, i.e. the heavy-duty transport device 24, can be moved together with the ballast pallet separate from the remaining crane 10. For this purpose, the guide frame 50 is demounted and the bracing rods 62 to the non-illustrated derrick boom are released. Releasing and separately transporting the guide frame 50 is not necessary, since otherwise the very heavy guide frame would also have to be held by the derrick boom. The derrick boom itself, however, only is supported by the reverse gear lock on the uppercarriage. Thus, not only a very great force would be applied at the derrick boom, but extremely unfavorable lifting conditions would be effective in addition. Moreover, with mounted guide frame 50 a great space would be required for travelling, which is not available in a multitude of operating sites. After reaching the operating site, the ballast carriage is again connected with the crane, so that it is available for further use.

Figure 4:
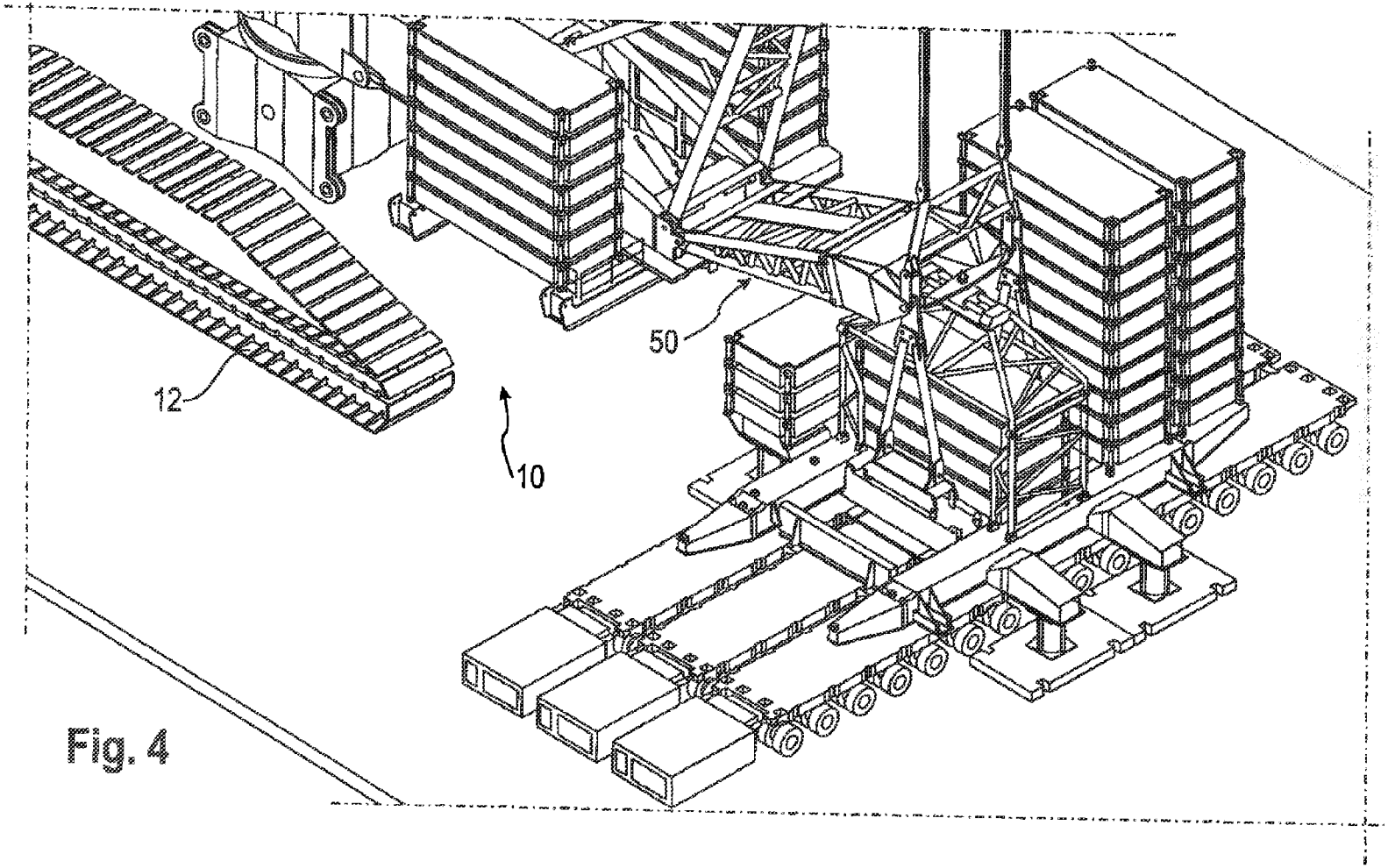
FIG. 4 shows a perspective partial view of a second embodiment of the crane in accordance with the present disclosure.

In FIG. 4 substantially the same construction is shown as in the above-discussed FIGS. 5 to 9. Here, merely the coupling point between the guide frame 50 and the frame 60 is configured differently. Instead of the oblong hole with guiding rods, guiding rods here are provided at the frame 60, which are enclosed by means of a coupling member.

Figure 10:
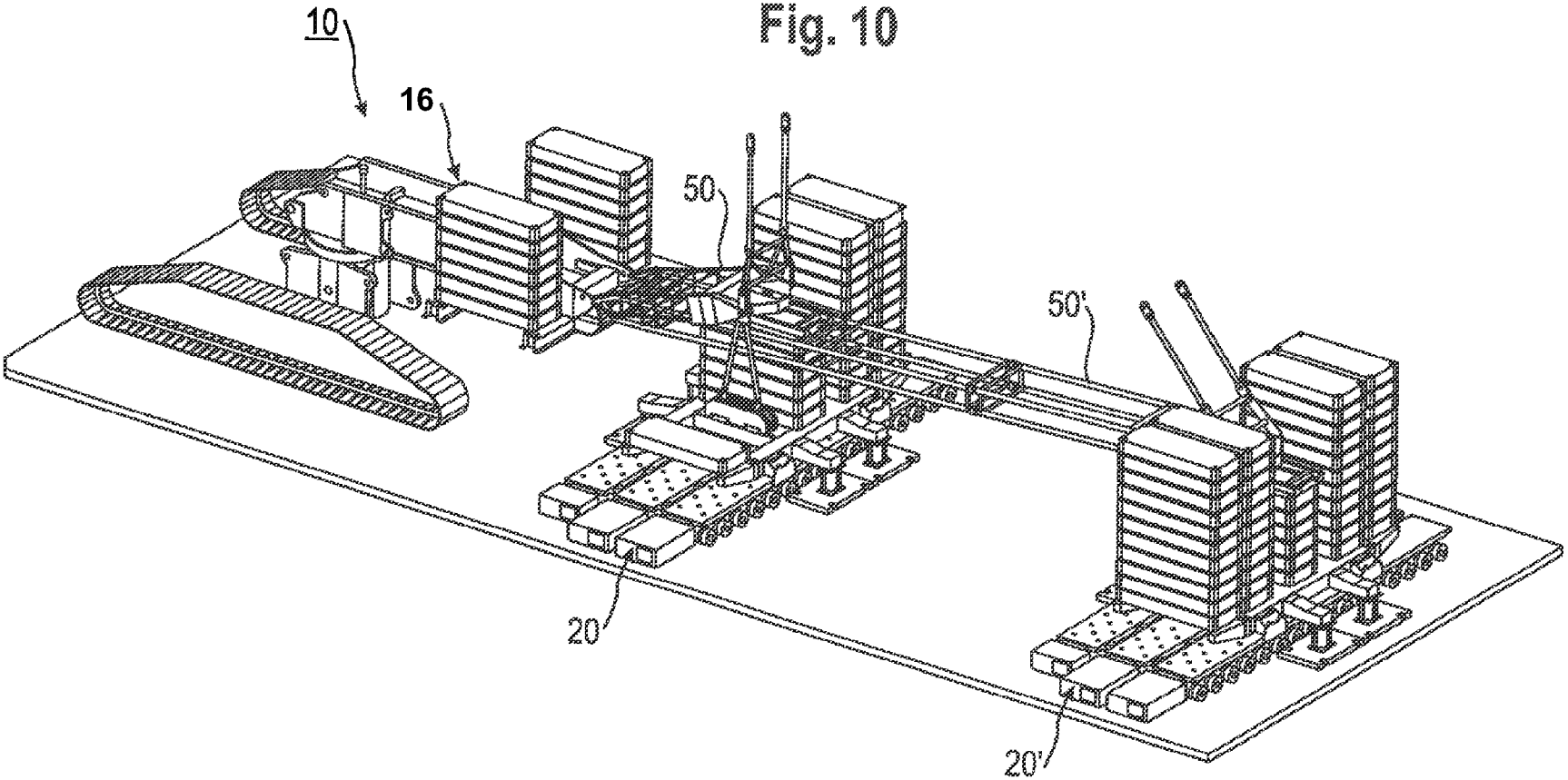
FIG. 10 shows a schematic, perspective representation of a further variant of the present disclosure.

In FIG. 10, finally, the ballast carriage is shown in two positions, wherein the ballast carriage 20, 20' each is connected to the uppercarriage 16 of the crane 10 via a shorter supporting frame 50 or a longer supporting frame 50'.

The invention claimed is:

1. A crane comprising:

a travelling undercarriage;

an uppercarriage rotatably mounted on the undercarriage with a luffing boom and a derrick boom arranged on the uppercarriage;

a ballast carriage connectable with the uppercarriage via a rigid guide frame with an articulation point, the rigid guide frame movably mounted with respect to the articulation point in an articulation region; and a ballast pallet hanging via at least one pendulum from the articulation point, wherein the rigid guide frame picks up ballast and puts the ballast down on the ballast carriage, wherein the ballast carriage is a transport device with its own drive and controller, the drive and controller of the ballast carriage separate from a drive and a controller of the travelling undercarriage, wherein the controller of the ballast carriage is influenced as a result of movement of the crane, wherein the ballast carriage is movable into a desired position by the drive of the ballast carriage, and wherein detected longitudinal movement of the rigid guide frame relative to a neutral position of the rigid guide frame is converted into an actuation signal for the controller of the ballast carriage.

2. The crane according to claim 1, wherein the controller of the ballast carriage, on rotating the crane, automatically determines a corresponding steering center, and in towing operation behind the crane, automatically generates steering, acceleration and/or deceleration commands.

3. The crane according to claim 1, wherein the pallet is mounted on the transport device and connected with the transport device.

4. The crane according to claim 1, wherein the longitudinal movement of the rigid guide frame is realized by a longitudinal guide with a pivot pin such that both longitudinal movement and rotary movement of the rigid guide frame are permitted, whereas no movement of the rigid guide frame is permitted in a transverse direction.

5. The crane according to claim 1, wherein the rigid guide frame is separable from the uppercarriage and/or ballast carriage.

6. The crane according to claim 1, wherein both the travelling undercarriage and the ballast carriage are movable separate from each other.

7. The crane according to claim 1, wherein supporting frames connecting the ballast carriage with the uppercarriage of the crane are extended via lattice pieces.

8. The crane according to claim 1, wherein the travelling undercarriage is movable, positionable, and adjustable by the controller of the travelling undercarriage, and the ballast carriage is movable, steerable, adjustable, and positionable by the controller of the ballast carriage.

9. The crane according to claim 1, wherein the pallet hangs from the articulation point via a plurality of pendulums, the pendulums comprising rods, which at their upper end are articulated to the rigid guide frame and at their lower end to the pallet directly or indirectly via spherical plain bearings.

10. The crane according to claim 9, wherein pendular movement of the pendulums is limited by emergency stops.

11. The crane according to claim 9, wherein pendular movement of the pendulums is detected via sensors, such that based on variables detected by the sensors, further actuation signals are generated for the controller of the ballast carriage.

12. The crane according to claim 10, wherein the ballast carriage is configured as a suspended ballast while separated from a travelling gear of the ballast carriage.

13. A crane comprising:

a travelling undercarriage;

an uppercarriage rotatably mounted on the undercarriage with a luffing boom and a derrick boom arranged on the uppercarriage;

a ballast carriage connectable with the uppercarriage via a rigid guide frame with an articulation point, the rigid guide frame movably mounted with respect to the articulation point in an articulation region; and a ballast pallet hanging via at least one pendulum from the articulation point, wherein the rigid guide frame picks up ballast and puts the ballast down on the ballast carriage, wherein the ballast carriage is a transport device with its own drive and controller, the drive and controller of the ballast carriage separate from a drive and a controller of the travelling undercarriage, wherein the controller of the ballast carriage is influenced as a result of movement of the crane, wherein the ballast carriage is movable into a desired position by the drive of the ballast carriage, wherein detected longitudinal movement of the rigid guide frame relative to a neutral position of the rigid guide frame is converted into an actuation signal for the controller of the ballast carriage, and wherein pendular movement of the at least one pendulum is detected via at least one sensor, such that based on variables detected by the at least one sensor, further actuation signals are generated for the controller of the ballast carriage.

14. The crane according to claim 13, wherein the at least one sensor comprises at least one angle sensor arranged at the at least one pendulum.

15. A crane comprising:

a travelling undercarriage;

an uppercarriage rotatably mounted on the undercarriage with a luffing boom and a derrick boom arranged on the uppercarriage;

a ballast carriage connectable with the uppercarriage via a rigid guide frame with an articulation point; and a ballast pallet hanging via at least one pendulum from the articulation point, wherein the rigid guide frame picks up ballast and puts the ballast down on the ballast carriage, wherein the ballast carriage is a transport device with its own drive and controller, the drive and controller of the ballast carriage separate from a drive and controller of the travelling undercarriage, wherein the controller of the ballast carriage is influenced as a result of movement of the crane, wherein the ballast carriage is movable into a desired position by the drive of the ballast carriage, and wherein pendular movement of the at least one pendulum is detected via at least one angle sensor, such that based on variables detected by the at least one angle sensor, further actuation signals are generated for the controller of the ballast carriage.

* * * * *